US009903038B2

(12) United States Patent
Niikura et al.

(10) Patent No.: US 9,903,038 B2
(45) Date of Patent: Feb. 27, 2018

(54) ZINC ALLOY PLATING METHOD

(71) Applicant: DIPSOL CHEMICALS CO., LTD., Tokyo (JP)

(72) Inventors: Toshihiro Niikura, Saitama (JP); Hirofumi Shiga, Tokyo (JP); Manabu Inoue, Tokyo (JP)

(73) Assignee: DIPSOL CHEMICALS CO., LTD., Tokyo (JP)

( * ) Notice: Subject to any disclaimer, the term of this patent is extended or adjusted under 35 U.S.C. 154(b) by 0 days.

(21) Appl. No.: 14/782,672

(22) PCT Filed: Jul. 22, 2015

(86) PCT No.: PCT/JP2015/070877
§ 371 (c)(1),
(2) Date: Oct. 6, 2015

(87) PCT Pub. No.: WO2016/075964
PCT Pub. Date: May 19, 2016

(65) Prior Publication Data
US 2017/0022625 A1 Jan. 26, 2017

(51) Int. Cl.
*C25D 3/56* (2006.01)
*C25D 17/00* (2006.01)
*C25D 3/22* (2006.01)

(52) U.S. Cl.
CPC ..... *C25D 17/002* (2013.01); *C25D 3/22* (2013.01); *C25D 3/565* (2013.01)

(58) Field of Classification Search
CPC ..... C25D 3/56; C25D 3/565
USPC ..... 205/244, 245, 246
See application file for complete search history.

(56) References Cited

U.S. PATENT DOCUMENTS

| | | | | |
|---|---|---|---|---|
| 5,590,383 | A | 12/1996 | Sekhar et al. | |
| 6,602,394 | B1 | 8/2003 | Hillebrand et al. | |
| 6,755,960 | B1 | 6/2004 | Frischauf et al. | |
| 6,767,437 | B2 | 7/2004 | Matsuda et al. | |
| 2004/0104123 | A1 | 6/2004 | Hillebrand et al. | |
| 2005/0189231 | A1* | 9/2005 | Capper | C25D 3/565 205/246 |
| 2007/0023280 | A1 | 2/2007 | Eckles et al. | |
| 2008/0164150 | A1 | 7/2008 | Hillebrand et al. | |

(Continued)

FOREIGN PATENT DOCUMENTS

| | | |
|---|---|---|
| CN | 1922343 A | 2/2007 |
| EP | 2 235 236 | 10/2010 |
| JP | 1-316499 | 12/1989 |

(Continued)

OTHER PUBLICATIONS

International Search Report for PCT/JP2015/070877 dated Aug. 18, 2015. (2 pages).
European Search Report for EP 15771004.7 dated Oct. 25, 2016.

*Primary Examiner* — Edna Wong
(74) *Attorney, Agent, or Firm* — Daniel R. Shelton; Foley & Lardner LLP

(57) ABSTRACT

The present invention provides a zinc alloy electroplating method comprising applying a current through an alkaline zinc alloy electroplating bath comprising a cathode and an anode, wherein a cathode region including the cathode and an anode region including the anode are separated from each other by a separator comprising an electrically conductive electrolyte gel.

9 Claims, 4 Drawing Sheets

PLATING TEST RESULTS (APPEARANCE OF PLATING)

| | EXAMPLE 1 | EXAMPLE 2 | COMP. EX. 1 |
|---|---|---|---|
| 0Ah/L | | | |
| 200Ah/L | | | |
| 400Ah/L | | | |
| 400Ah/L (CONCENTRATION OF IZ-250YB WAS ADJUSTED TO 60 g/L) | | | |

(56) References Cited

U.S. PATENT DOCUMENTS

| | | | |
|---|---|---|---|
| 2009/0107845 | A1 | 4/2009 | Karlheinz et al. |
| 2011/0031127 | A1 | 2/2011 | Hillebrand et al. |

FOREIGN PATENT DOCUMENTS

| | | |
|---|---|---|
| JP | 2002-521572 | 7/2002 |
| JP | 2005-248319 | 9/2005 |
| JP | 2007-2274 | 1/2007 |
| JP | 2008-539329 | 11/2008 |
| WO | WO 2004/108995 | 12/2004 |

* cited by examiner

PLATING TEST RESULTS (APPEARANCE OF PLATING)

ZINC ALLOY PLATING METHOD

RELATED APPLICATIONS

This application is the U.S. National Stage of and claims the benefit of priority to International Patent Application Number PCT/JP2015/070877, filed Jul. 22, 2015. The entire contents of the foregoing are hereby incorporated herein by reference.

TECHNICAL FIELD

The present invention relates to a zinc alloy plating method. Specifically, the present invention relates to a plating method by which a plating bath can be used for a long period with the performance of the plating bath being maintained with a simple anode separation apparatus in performing alkaline zinc alloy plating excellent in corrosion prevention characteristics on a steel member or the like.

BACKGROUND ART

Zinc alloy plating has a better corrosion resistance than zinc plating, and hence has been widely used for automobile components and the like. Among types of zinc alloy plating, especially alkaline zinc-nickel alloy plating has been used for fuel system components required to have high corrosion resistance and engine components placed under high-temperature environments. An alkaline zinc-nickel alloy plating bath is a plating bath in which nickel is dissolved with an amine-based chelating agent selected to be suitable in terms of Ni co-deposition ratio, and zinc and nickel are co-deposited in a plated coating. However, when alkaline zinc-nickel alloy plating is performed, there arises a problem of oxidative decomposition of the amine-based chelating agent in the vicinity of the anode during current application. The oxidative decomposition of the amine-based chelating agent is caused by active oxygen generated at the anode. When ions of an iron group metal such as nickel ions or iron ions are coexistent, these ions act as an oxidation catalyst, and further promote the oxidative decomposition of the amine-based chelating agent. Accordingly, when an alkaline zinc-nickel alloy plating liquid comes into contact with an anode, the amine-based chelating agent rapidly decomposes, resulting in deterioration in plating performance. Accumulation of products of the decomposition causes many problems such as decrease in current efficiency, increase in bath voltage, decrease in plating thickness, decrease in nickel content in plated coating, narrowing of a permissible current density range for the plating, decrease in gloss, and increase in COD. For this reason, the plating liquid cannot be used for a long period, and has to be exchanged.

As methods for improvement in this point, some methods have been known so far. For example, Published Japanese Translation of PCT International Application No. 2002-521572 discloses a method in which a catholyte and an acidic anolyte in an alkaline zinc-nickel bath are separated from each other by a cation exchange membrane made of a perfluorinated polymer. However, when an acidic liquid is used as the anolyte, it is necessary to use an expensive corrosion-resistant member, such as platinum-plated titanium, as the anode. In addition, when the separation membrane is broken, there is a possibility of an accident in which the acidic solution on the anode side and the alkaline solution on the cathode side are mixed with each other to cause a rapid chemical reaction. Meanwhile, a plating test conducted by the present inventors has revealed that when an alkaline liquid is used as the anolyte instead of the acidic liquid, the anolyte rapidly moves to the catholyte upon current application, causing the lowering of the liquid level of the anolyte and the elevation of the liquid level of the catholyte simultaneously.

As a method for solving the above-described problems, Japanese Patent Application Publication No. 2007-2274 describes a method in which a cation exchange membrane is used, and an alkali component is supplemented to an alkaline anolyte. However, this method requires an additional apparatus, liquid management, and the like, which complicate the operations.

In addition, Published Japanese Translation of PCT International Application No. 2008-539329 discloses a zinc alloy plating bath in which a cathode and an anode are separated from each other by a filtration membrane. However, a test conducted by the present inventors has shown that the disclosed filtration membrane is incapable of preventing movement between the catholyte and the anolyte, and incapable of preventing decomposition of a chelating agent at the anode. In addition, since a zinc alloy plating liquid is used also as the anolyte, the decomposition of the anolyte is promoted very much. Accordingly, the anolyte has to be exchanged, and when the anolyte is not exchanged, the decomposition product moves into the plating liquid at the cathode. For this reason, it has been found that this method does not lead to substantial extension of the lifetime of the liquid.

SUMMARY OF INVENTION

An object of the present invention is to provide a plating method which can achieve lifetime extension of a zinc alloy plating bath by maintaining the performance of the zinc alloy plating bath with an economical apparatus in which the anode separation is achieved easily and in which the liquid level is easy to manage.

The present invention has been made based on the following finding. Specifically, in an alkaline zinc alloy electroplating bath comprising a cathode and an anode, a cathode region including the cathode and an anode region including the anode are separated from each other by a separator comprising an electrically conductive electrolyte gel. In this case, it is possible to suppress or prevent the movement of a plating liquid, especially, the movement of a quaternary ammonium salt-based brightening agent and an amine-based chelating agent, so that the oxidative decomposition of the amine-based chelating agent and the quaternary ammonium salt-based brightening agent in the bath is suppressed. In addition, it has been found that the electrolyte in the anode region does not move to the cathode region, either, and the liquid level in each region does not change, so that the liquid levels can be managed without any problem. Specifically, the present invention provides a zinc alloy electroplating method comprising applying a current through an alkaline zinc alloy electroplating bath comprising a cathode and an anode, wherein a cathode region including the cathode and an anode region including the anode are separated from each other by a separator comprising an electrically conductive electrolyte gel.

The present invention makes it possible to provide a plating method which can achieve lifetime extension of a zinc alloy plating bath by maintaining the performance of the zinc alloy plating bath with an economical apparatus in which the anode separation is achieved easily and in which the liquid level is easy to manage.

DESCRIPTION OF EMBODIMENTS

Figure 1:
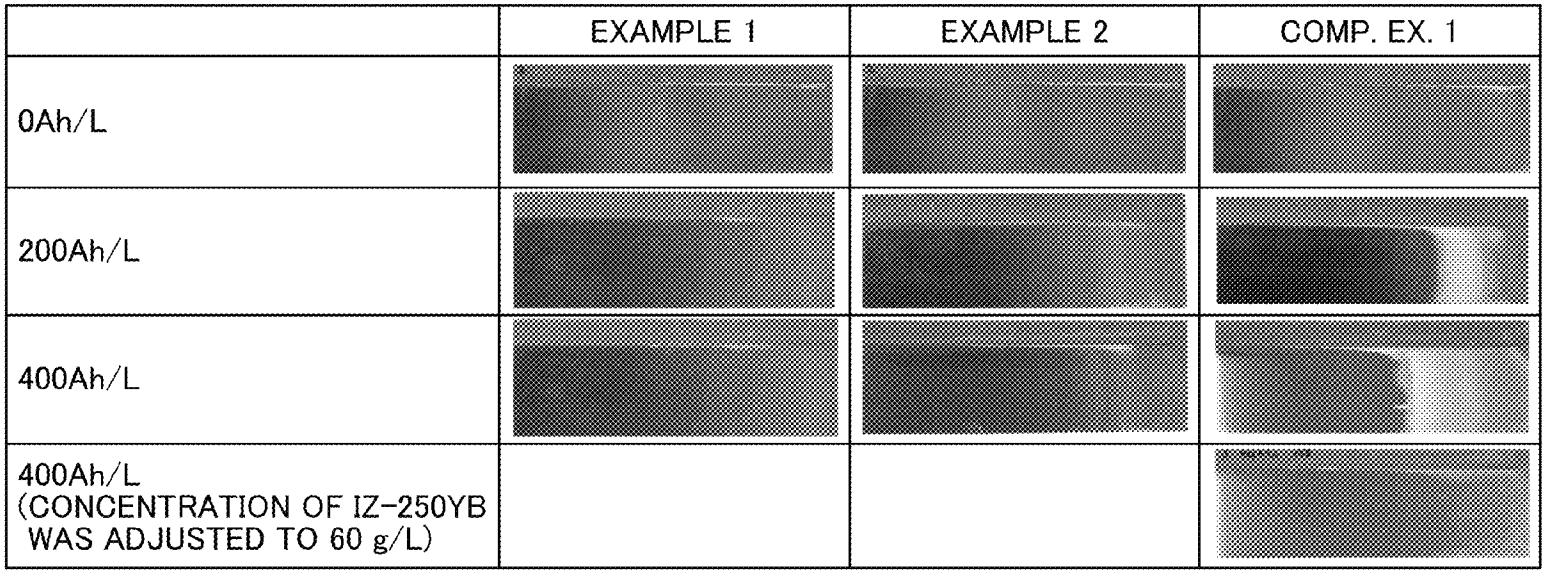
FIG. 1 shows plating test results (appearance of plating) of Examples 1 and 2 and Comparative Example 1.
Figure 2:
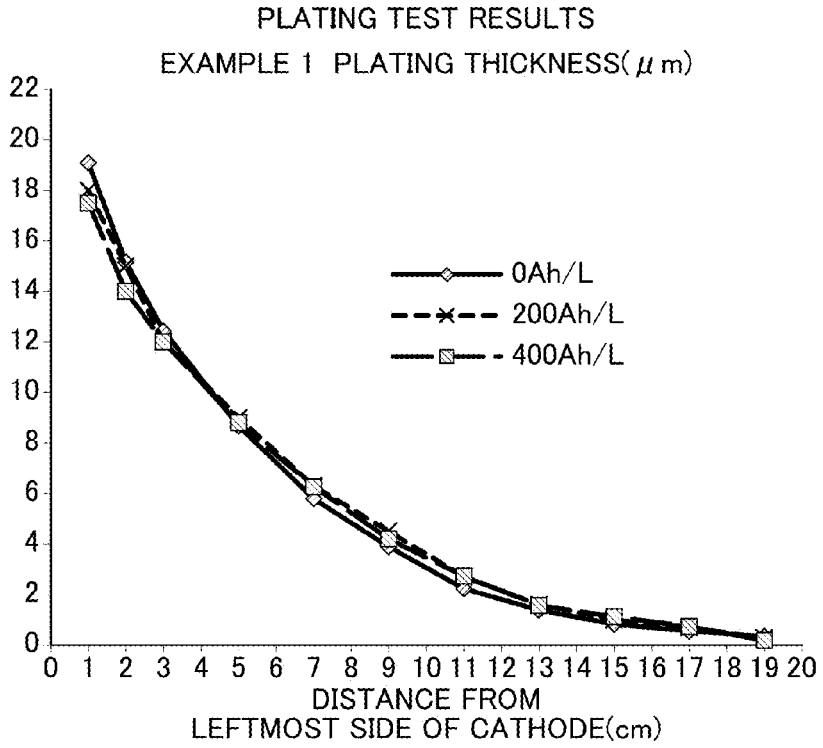
FIG. 2 shows plating test results (plating thickness distribution) of Example 1.
Figure 3:
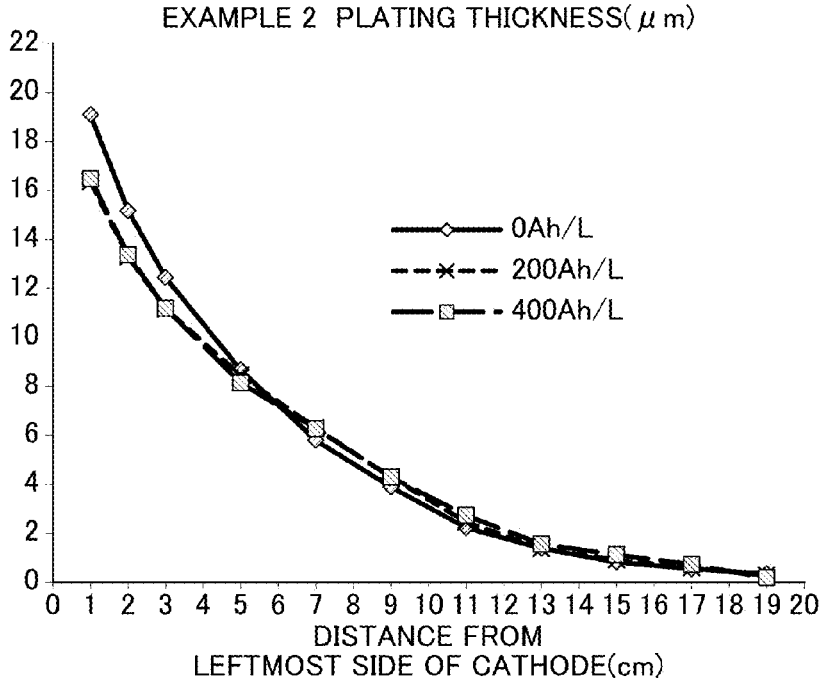
FIG. 3 shows plating test results (plating thickness distribution) of Example 2.
Figure 4:
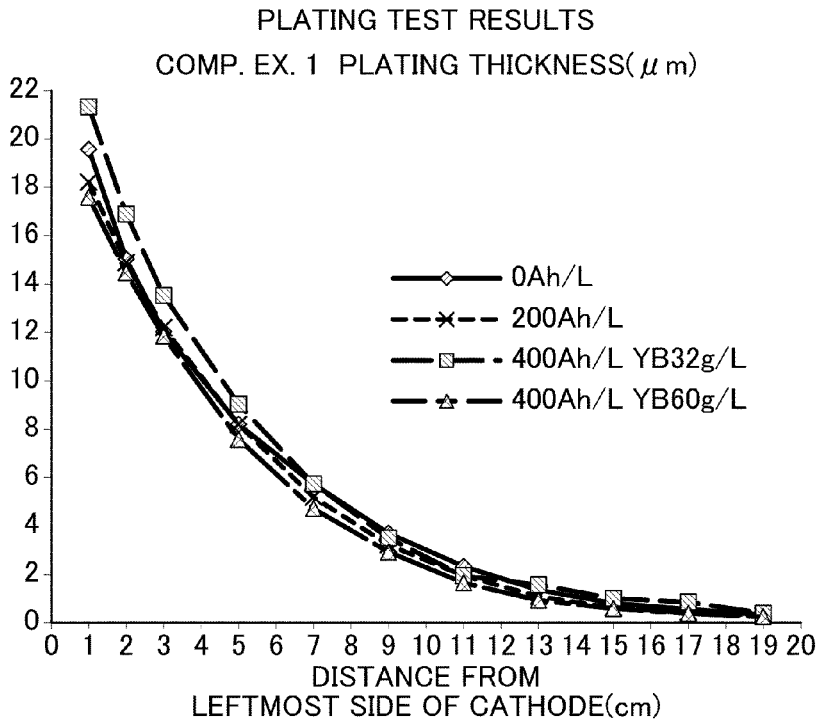
FIG. 4 shows plating test results (plating thickness distribution) of Comparative Example 1.
Figure 5:
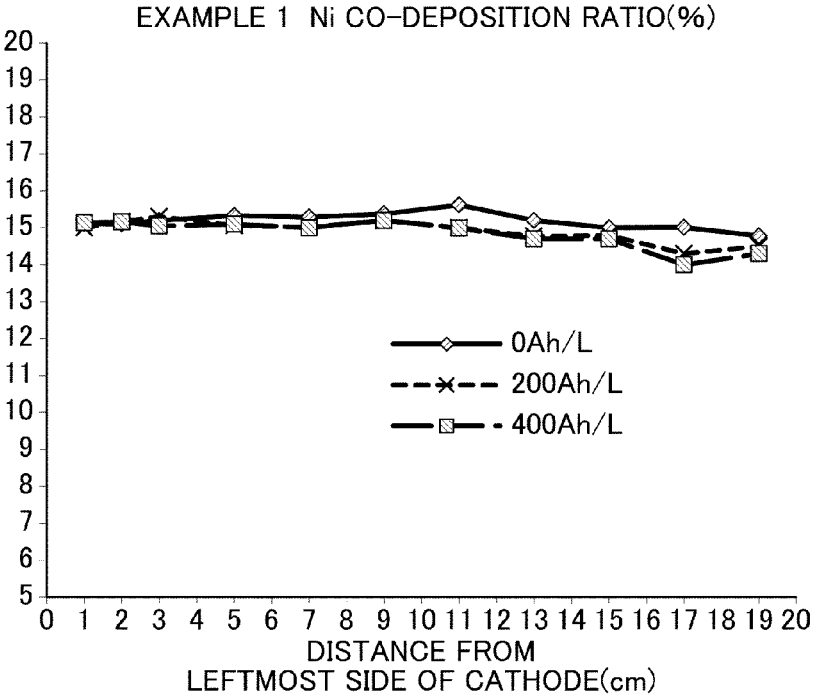
FIG. 5 shows plating test results (Ni co-deposition ratio distribution) of Example 1.
Figure 6:
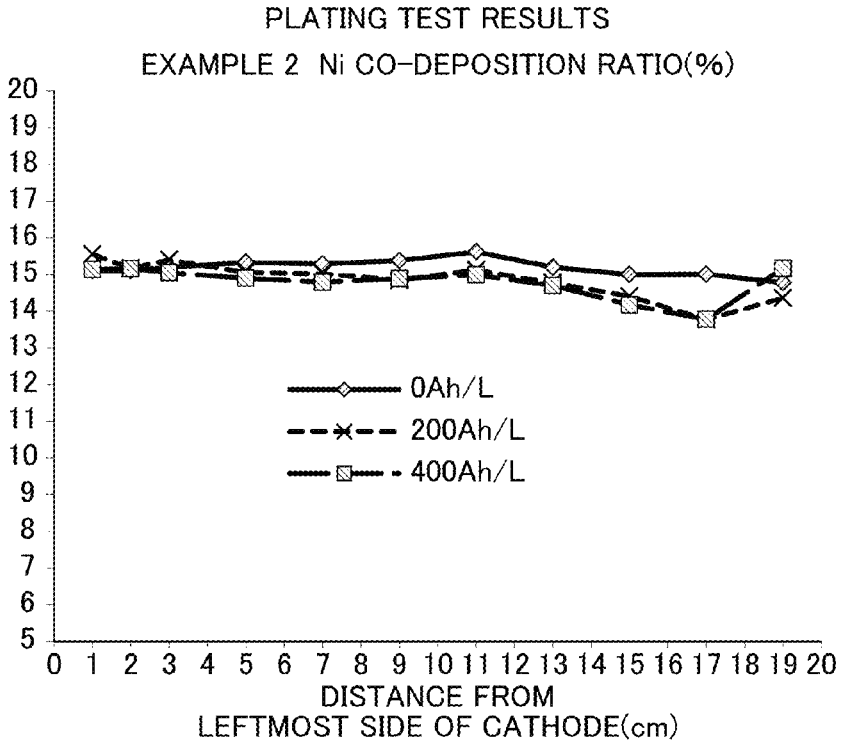
FIG. 6 shows plating test results (Ni co-deposition ratio distribution) of Example 2.
Figure 7:
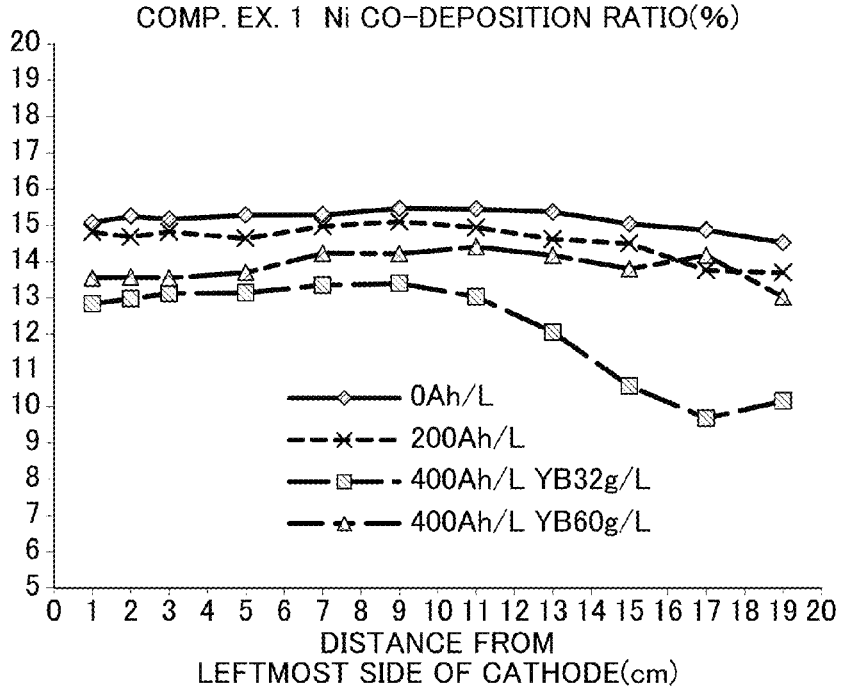
FIG. 7 shows plating test results (Ni co-deposition ratio distribution) of Comparative Example 1.

A method of the present invention is a zinc alloy electroplating method comprising applying a current through an alkaline zinc alloy electroplating bath comprising a cathode and an anode, wherein a cathode region including the cathode and an anode region including the anode are separated from each other by a separator comprising an electrically conductive electrolyte gel.

The metal used in combination with zinc in the zinc alloy plating is, for example, one or more metals selected from nickel, iron, cobalt, tin, and manganese. Specifically, the zinc alloy plating may be zinc-nickel alloy plating, zinc-iron alloy plating, zinc-cobalt alloy plating, zinc-manganese alloy plating, zinc-tin alloy plating, zinc-nickel-cobalt alloy plating, or the like, but is not limited to these types of alloy plating. The zinc alloy plating is preferably zinc-nickel alloy plating.

The separator preferably comprises the electrically conductive electrolyte gel and a support. The separator more preferably comprises a composite membrane in which a membrane of the electrically conductive electrolyte gel and a support are stacked on each other. The separator further preferably comprises a three-layered composite membrane in which a support, a membrane of the electrically conductive electrolyte gel, and another support are stacked in this order.

The electrically conductive electrolyte gel is an electrolyte gel of a water-absorbing synthetic polymer with an electrical conductivity of preferably 140000 μS/cm or higher, and more preferably 300000 μS/cm or higher. In addition, the electrically conductive electrolyte gel is preferably an electrolyte gel of a water-absorbing synthetic polymer swollen by absorption of an aqueous sodium hydroxide solution as an electrolyte with a volume expansion ratio of, for example, 100% or higher and preferably 150 to 300%. The water-absorbing synthetic polymer is not particularly limited, unless a function of the electrolyte gel according to the present invention is impaired. Examples of the water-absorbing synthetic polymer include polyvinyl alcohol, polyethylene glycol, poly(carboxylic acids), polyacrylamide, and polyvinyl acetal, as well as modified products thereof such as sodium salts, products of modification by introducing carboxy groups, sulfone groups, or cationic functional groups, or the like. The water-absorbing synthetic polymer is preferably polyvinyl alcohol, polyethylene glycol, a poly(carboxylic acid), or a modified product thereof. In addition, these synthetic polymers may be used, after being cross-linked with a cross-linking agent such as a boronic acid ester compound. One of these synthetic polymers may be used alone, or two or more thereof may be used in combination.

The support is not particularly limited, unless a function of the electrolyte gel contained in the separator is impaired. The support may be, for example, an ion exchange membrane, a filtration membrane, or the like.

The ion exchange membrane may be an anion exchange membrane, a cation exchange membrane, or the like.

The anion exchange membrane is preferably a hydrocarbon-based anion exchange membrane, and particularly preferably a hydrocarbon-based quaternary ammonium base-type anion exchange membrane. The form of the anion exchange membrane is not particularly limited, either, and the anion exchange membrane may be a membrane of an ion-exchange resin itself, a membrane obtained by filling pores of a microporous film such as an olefin-based microporous film with an anion exchange resin, a layered membrane of a microporous film and an anion exchange membrane.

In addition, the filtration membrane is preferably an UF membrane, a NF membrane, a RO membrane, or the like of a ceramic, PTFE, polysulfone, polypropylene, or the like with a pore diameter of about 0.1 to 10 μm.

The separator more preferably comprises a composite membrane in which a membrane of the synthetic polymer electrolyte gel and at least one of an ion exchange membrane and a filtration membrane are stacked on each other. The separator further preferably comprises a three-layered composite membrane in which an anion exchange membrane, a membrane of the synthetic polymer electrolyte gel, and another anion exchange membrane are stacked in this order.

The anode is preferably iron, stainless steel, nickel, carbon, or the like, or also may be a corrosion resistant metal such as platinum-plated titanium or palladium-tin alloy.

The cathode is a workpiece to be plated with a zinc alloy. The workpiece may be one made of a metal or an alloy such as iron, nickel, and copper, an alloy thereof, or zincated aluminum in a shape a plate, a cuboid, a solid cylinder, a hollow cylinder, a sphere, or the like.

In the present invention, a catholyte contained in the cathode region is an alkaline zinc alloy plating liquid.

The alkaline zinc alloy plating liquid contains zinc ions. The concentration of the zinc ions is preferably 2 to 20 g/L, and further preferably 4 to 12 g/L. A zinc ion source may be $Na_2[Zn(OH)_4]$, $K_2[Zn(OH)_4]$, ZnO, or the like. One of these zinc ion sources may be used alone, or two or more thereof may be used in combination.

In addition, the alkaline zinc alloy plating liquid contains metal ions of one or more species selected from nickel ions, iron ions, cobalt ions, tin ions, and manganese ions. The total concentration of the metal ions is preferably 0.4 to 4 g/L, and further preferably 1 to 3 g/L. Sources of the metal ions include nickel sulfate, iron (II) sulfate, cobalt sulfate, tin (II) sulfate, manganese sulfate, and the like. One of these metal ion sources may be used alone, or two or more thereof may be used in combination. The alkaline zinc alloy plating liquid is preferably an alkaline zinc-nickel alloy plating liquid containing nickel ions as the metal ions.

In addition, the alkaline zinc alloy plating liquid preferably contains a caustic alkali. The caustic alkali may be sodium hydroxide, potassium hydroxide, or the like. The concentration of the caustic alkali is preferably 60 to 200 g/L, and further preferably 100 to 160 g/L.

In addition, the alkaline zinc alloy plating liquid preferably contains an amine-based chelating agent. Examples of the amine-based chelating agent include alkyleneamine compounds such as ethylenediamine, triethylenetetramine, and tetraethylenepentamine; ethylene oxide or propylene oxide adducts of the above-described alkyleneamines; amino alcohols such as N-(2-aminoethyl)ethanolamine and 2-hydroxyethylaminopropylamine; poly(hydroxyalkyl) alkylenediamines such as N-2(-hydroxyethyl)-N,N',N'-triethylethylenediamine, N,N'-di(2-hydroxyethyl)-N,N'-diethylethylenediamine, N,N,N',N'-tetrakis(2-hydroxyethyl) propylenediamine, and N,N,N',N'-tetrakis(2-hydroxypropyl)ethylenediamine; poly(alkyleneimines) obtained from ethyleneimine, 1,2-propyleneimine, and the like; poly(alkyleneamines) and poly(amino alcohols) obtained from ethylenediamine, triethylenetetramine, ethanolamine, diethanolamine, and the like; etc. One of these amine-based chelating agents may be used alone, or two or more thereof may be used in combination. The concentration of the amine-based chelating agent is preferably 5 to 200 g/L, and further preferably 30 to 100 g/L.

The alkaline zinc alloy plating liquid used in the present invention may further comprise one or more selected from the group consisting of auxiliary additives such as brightening agents and leveling agents, and anti-foaming agents. The alkaline zinc alloy plating liquid used in the present invention preferably comprises a brightening agent.

The brightening agent is not particularly limited, as long as the brightening agent is known for a zinc-based plating bath. Examples of the brightening agent include (1) nonionic surfactants such as polyoxyethylene-polyoxypropylene block polymer and EO adduct of acetylene glycol, and anionic surfactants such as polyoxyethylene lauryl ether sulfuric acid salts and alkyldiphenyl ether disulfonic acid salts; (2) polyamine compounds including polyallylamines such as a copolymer of diallyldimethylammonium chloride and sulfur dioxide; polyepoxy-polyamines such as a condensation polymer of ethylenediamine with epichlorohydrin, a condensation polymer of dimethylaminopropylamine with epichlorohydrin, a condensation polymer of imidazole with epichlorohydrin, condensation polymers of imidazole derivatives such as 1-methylimidazole and 2-methylimidazole with epichlorohydrin, and condensation polymers of heterocyclic amine including triazine derivatives such as acetoguanamine and benzoguanamine and the like with epichlorohydrin; polyamide-polyamines including polyamine-polyurea resins such as a condensation polymer of 3-dimethylaminopropylurea with epichlorohydrin and a condensation polymer of bis(N,N-dimethylaminopropyl) urea with epichlorohydrin and water-soluble nylon resins such as condensation polymers of N,N-dimethylaminopropylamine, an alkylenedicarboxylic acid, and epichlorohydrin, and the like; polyalkylene-polyamines such as condensation polymers of diethylenetriamine, dimethylaminopropylamine, or the like with 2,2'-dichlorodiethyl ether, a condensation polymer of dimethylaminopropylamine with 1,3-dichloro propane, a condensation polymer of N,N,N',N'-tetramethyl-1,3-diaminopropane with 1,4-dichlorobutane, a condensation polymer of N,N,N',N'-tetramethyl-1,3-diaminopropane with 1,3-dichloropropan-2-ol; and the like; (3) condensation polymers of dimethylamine or the like with dichloroethyl ether; (4) aromatic aldehydes such as veratraldehyde, vanillin, and anisaldehyde, benzoic acid, and salts thereof; (5) quaternary ammonium salts such as cetyltrimethylammonium chloride and 3-carbamoylbenzylpyridinium chloride; and the like. Of these brightening agents, quaternary ammonium salts and aromatic aldehydes are preferable. One of these brightening agents may be used alone, or two or more thereof may be used in combination. The concentration of the brightening agent is preferably 1 to 500 mg/L, and further preferably 5 to 100 mg/L in the case of an aromatic aldehyde, benzoic acid, or a salt thereof. In other cases, the concentration is preferably 0.01 to 10 g/L, and further preferably 0.02 to 5 g/L.

In addition, the alkaline zinc alloy plating liquid used in the present invention preferably comprises a brightening agent being a nitrogen-containing heterocyclic quaternary ammonium salt. The nitrogen-containing heterocyclic quaternary ammonium salt brightening agent is more preferably a carboxy group- and/or hydroxy group-substituted nitrogen-containing heterocyclic quaternary ammonium salt. Examples of the nitrogen-containing heterocycle of the nitrogen-containing heterocyclic quaternary ammonium salt include a pyridine ring, a piperidine ring, an imidazole ring, an imidazoline ring, a pyrrolidine ring, a pyrazole ring, a quinoline ring, a morpholine ring, and the like. The nitrogen-containing heterocycle is preferably a pyridine ring. A quaternary ammonium salt of nicotinic acid or a derivative thereof is particularly preferable. In the quaternary ammonium salt compound, the carboxy group and/or the hydroxy group may be introduced onto the nitrogen-containing heterocycle as a substituent through another substituent as in the case of, for example, a carboxymethyl group. Moreover, the nitrogen-containing heterocycle may have substituents such as alkyl groups, in addition to the carboxy group and/or the hydroxy group. In addition, unless an effect achieved by the brightening agent contained is impaired, the N substituents forming the heterocyclic quaternary ammonium cation are not particularly limited, and examples thereof include substituted or non-substituted alkyl, aryl, or alkoxy groups, and the like. In addition, examples of the counter anion forming the salt include halogen anions, oxyanions, borate anions, sulfonate anion, phosphate anions, imide anion, and the like, and the counter anion is preferably a halogen anion. Such a quaternary ammonium salt is preferable, because it contains both a quaternary ammonium cation and an oxyanion in its molecule, and hence it behaves also as an anion. Specific examples of the nitrogen-containing heterocyclic quaternary ammonium salt compound include N-benzyl-3-carboxypyridinium chloride, N-phenethyl-4-carboxypyridinium chloride, N-butyl-3-carboxypyridinium bromide, N-chloromethyl-3-carboxypyridinium bromide, N-hexyl-6-hydroxy-3-carboxypyridinium chloride, N-hexyl-6-3-hydroxypropyl-3-carboxypyridinium chloride, N-2-hydroxyethyl-6-methoxy-3-carboxypyridinium chloride, N-methoxy-6-methyl-3-carboxypyridinium chloride, N-propyl-2-methyl-6-phenyl-3-carboxypyridinium chloride, N-propyl-2-methyl-6-phenyl-3-carboxypyridinium chloride, N-benzyl-3-carboxymethylpyridinium chloride, 1-butyl-3-methyl-4-carboxyimidazolium bromide, 1-butyl-3-methyl-4-carboxymethylimidazolium bromide, 1-butyl-2-hydroxymethyl-3-methylimidazolium chloride, 1-butyl-1-methyl-3-methylcarboxypyrrolidinium chloride, 1-butyl-1-methyl-4-methylcarboxypiperidinium chloride, and the like. One of these nitrogen-containing heterocyclic quaternary ammonium salts may be used alone, or two or more thereof may be used in combination. The concentration of the nitrogen-containing heterocyclic quaternary ammonium salt is preferably 0.01 to 10 g/L, and further preferably 0.02 to 5 g/L.

Examples of the auxiliary additives include organic acids, silicates, mercapto compounds, and the like. One of these the auxiliary additives may be used alone, or two or more thereof may be used in combination. The concentration of the auxiliary additive is preferably 0.01 to 50 g/L.

Examples of the anti-foaming agents include surfactants and the like. One of these anti-foaming agents may be used alone, or two or more thereof may be used in combination. The concentration of the anti-foaming agent is preferably 0.01 to 5 g/L.

In the present invention, an anolyte contained in the anode region is an aqueous alkaline solution.

The aqueous alkaline solution may be, for example, an aqueous solution containing one or more selected from the group consisting of caustic alkalis, sodium, potassium, and ammonium salts of inorganic acids, and quaternary tetraalkylammonium hydroxides. The caustic alkalis include sodium hydroxide, potassium hydroxide, and the like. The inorganic acids include sulfuric acid and the like. The quaternary tetraalkylammonium hydroxides (preferably, the alkyls are alkyls having 1 to 4 carbon atoms) include quaternary tetramethylammonium hydroxide and the like. When the aqueous alkaline solution is an aqueous solution containing a caustic alkali, the concentration of the caustic alkali is preferably 0.5 to 8 mol/L, and further preferably 2.5 to 6.5 mol/L. When the aqueous alkaline solution is an aqueous solution containing a sodium, potassium, or ammonium salt of an inorganic acid, the concentration of the inorganic acid salt is preferably 0.1 to 1 mol/L, and further preferably 0.2 to 0.5 mol/L. When the aqueous alkaline solution is an aqueous solution containing a quaternary tetraalkylammonium hydroxide, the concentration of the quaternary tetraalkylammonium hydroxide is preferably 0.5 to 6 mol/L, and further preferably 1.5 to 3.5 mol/L. The aqueous alkaline solution is preferably an aqueous solution containing a caustic alkali, and more preferably an aqueous solution containing sodium hydroxide.

The temperature for performing the zinc alloy plating is preferably 15° C. to 40° C., and further preferably 25 to 35° C. The cathode current density for performing the zinc alloy plating is preferably 0.1 to 20 A/dm$^2$, and further preferably 0.2 to 10 A/dm$^2$.

In addition, the zinc alloy electroplating method of the present invention preferably comprises controlling the alkali concentration by adding an alkali component to the aqueous alkaline solution.

Next, the present invention is described based on Examples and Comparative Examples; however, the present invention is not limited thereto.

EXAMPLES

Example 1

Zinc-nickel alloy plating was obtained as follows. Specifically, a cathode and an anode were separated from each other by a polyolefin film which had a pore diameter of 3 μm and which was filled with an electrically conductive electrolyte gel obtained by swelling polyvinyl alcohol by absorption of a 130 g/L aqueous sodium hydroxide solution (volume expansion ratio: 200%) and having an electric conductivity of approximately 380000 μS/cm. An alkaline zinc-nickel alloy plating liquid shown below was used as a catholyte for a cathode chamber (500 mL), and a 130 g/L (3.3 mol/L) aqueous caustic soda solution was used as an anolyte for an anode chamber (50 mL). A current was applied at 400 Ah/L. The cathode current density was 4 A/dm$^2$, the anode current density was 16 A/dm$^2$, and the plating bath temperature was 25° C. The plating liquid was kept at 25° C. by cooling. An iron plate was used as the cathode, and a nickel plate was used as the anode. Note that the iron plate serving as the cathode was exchanged every 16 Ah/L during the current application. The zinc ion concentration in the catholyte was kept constant by immersing and dissolving zinc metal. The nickel ion concentration was kept constant by supplying an aqueous solution containing 25% by weight of nickel sulfate hexahydrate and 10% by weight of IZ-250YB. The caustic soda concentrations in the catholyte and the anolyte were periodically analyzed, and caustic soda was supplied to keep the concentrations constant. As brightening agents, polyamine-based IZ-250YR1 (manufactured by DIPSOL CHEMICALS Co., Ltd.) and nitrogen-containing heterocyclic quaternary ammonium salt-based IZ-250YR2 (manufactured by DIPSOL CHEMICALS Co., Ltd.) were supplied at supply rates of 15 mL/kAh and 15 mL/kAh, respectively, for the plating. The amine-based chelating agent IZ-250YB was supplied at an IZ-250YB supply rate of 80 mL/kAh for the plating. Every 200 Ah/L current application, the concentration of the amine-based chelating agent and the concentration of the nitrogen-containing heterocyclic quaternary ammonium salt-based brightening agent in the catholyte were analyzed. In addition, a plating test was conducted in accordance with the Hull cell test by using a long cell using a 20 cm iron plate as a cathode, and the appearance of the plating, the film thickness distribution, and the Ni co-deposition ratio distribution were measured. Note that the conditions for the plating test were 4 A, 20 minutes, and 25° C.

Composition of Plating Liquid:

Zn ion concentration: 8 g/L (Zn ion source was $Na_2[Zn(OH)_4]$)

Ni ion concentration: 1.6 g/L (Ni ion source was $NiSO_4.6H_2O$)

Caustic soda concentration: 130 g/L

Amine-based chelating agent (alkylene oxide adduct of alkyleneamine) IZ-250YB (manufactured by DIPSOL CHEMICALS Co., Ltd.): 60 g/L Brightening agent IZ-250YR1 (manufactured by DIPSOL CHEMICALS Co., Ltd.): 0.6 mL/L (polyamine: 0.1 g/L)

Brightening agent IZ-250YR2 (manufactured by DIPSOL CHEMICALS Co., Ltd.): 0.5 mL/L (quaternary ammonium salt of nicotinic acid: 0.2 g/L)

Example 2

Zinc-nickel alloy plating was obtained as follows. Specifically, an cathode and an anode were separated from each other by an anion exchange membrane SELEMION (manufactured by Asahi Glass Co., Ltd., hydrocarbon-based quaternary ammonium base-type anion exchange membrane) filled with an electrically conductive electrolyte gel which was obtained by swelling polyvinyl alcohol by absorption of a 130 g/L aqueous sodium hydroxide solution (volume expansion ratio: 200%) and which had an electric conductivity of approximately 380000 μS/cm. An alkaline zinc-nickel alloy plating liquid shown below was used as a catholyte for a cathode chamber (500 mL), and a 130 g/L aqueous caustic soda solution was used as an anolyte for an anode chamber (50 mL). A current was applied at 400 Ah/L. The cathode current density was 4 A/dm$^2$, the anode current density was 16 A/dm$^2$, and the plating bath temperature was 25° C. The plating liquid was maintained at 25° C. by cooling. An iron plate was used as the cathode, and a nickel plate was used as the anode. Note that the iron plate serving as the cathode was exchanged every 16 Ah/L during the current application. The zinc ion concentration in the catholyte was kept constant by immersing and dissolving zinc metal. The nickel ion concentration was kept constant by supplying an aqueous solution containing a 25% by weight of nickel sulfate hexahydrate and 10% by weight of IZ-250YB. The caustic soda concentrations in the catholyte and the anolyte were periodically analyzed, and caustic soda was supplied to keep the concentrations constant. As brightening agents, polyamine-based IZ-250YR1 (manufactured by DIPSOL CHEMICALS Co., Ltd.) and nitrogen-containing heterocyclic quaternary ammonium salt-based IZ-250YR2 (manufactured by DIPSOL CHEMICALS Co., Ltd.) were supplied at supply rates of 15 mL/kAh and 15 mL/kAh, respectively, for the plating. An amine-based chelating agent IZ-250YB was supplied at an IZ-250YB supply rate of 80 mL/kAh for the plating. Every 200 Ah/L current application, the concentration of the amine-based chelating agent and the concentration of the nitrogen-containing heterocyclic quaternary ammonium salt-based brightening agent in the catholyte were analyzed. In addition, a plating test was conducted in accordance with the Hull cell test by using a long cell using a 20 cm iron plate as a cathode, and the appearance of plating, the film thickness distribution, and the Ni co-deposition ratio distribution were measured. Note that the conditions for the plating test were 4 A, 20 minutes, and 25° C.

Composition of Plating Liquid:

Zn ion concentration: 8 g/L (Zn ion source was $Na_2[Zn(OH)_4]$)

Ni ion concentration: 1.6 g/L (Ni ion source was $NiSO_4.6H_2O$)

Caustic soda concentration: 130 g/L

Amine-based chelating agent IZ-250YB (manufactured by DIPSOL CHEMICALS Co., Ltd.): 60 g/L Brightening agent IZ-250YR1 (manufactured by DIPSOL CHEMICALS Co., Ltd.): 0.6 mL/L Brightening agent IZ-250YR2 (manufactured by DIPSOL CHEMICALS Co., Ltd.): 0.5 mL/L

Comparative Example 1

Without separating a cathode from an anode, zinc-nickel alloy plating was obtained by using an alkaline zinc-nickel alloy plating liquid (500 mL) shown below and applying a current at 400 Ah/L. The cathode current density was 4 A/dm$^2$, the anode current density was 16 A/dm$^2$, and the plating bath temperature was 25° C. The plating liquid was kept at 25° C. by cooling. An iron plate was used as the cathode, and a nickel plate was used as the anode. Note that the iron plate serving as the cathode was exchanged every 16 Ah/L during the current application. The zinc ion concentration was kept constant by immersing and dissolving zinc metal. The nickel ion concentration was kept constant by supplying an aqueous solution containing a 25% by weight of nickel sulfate hexahydrate and 10% by weight of IZ-250YB. The caustic soda concentration was periodically analyzed, and caustic soda was supplied to keep the concentration constant. As brightening agents, polyamine-based IZ-250YR1 (manufactured by DIPSOL CHEMICALS Co., Ltd.) and nitrogen-containing heterocyclic quaternary ammonium salt-based IZ-250YR2 (manufactured by DIPSOL CHEMICALS Co., Ltd.) were supplied at supply rates of 15 mL/kAh and 15 mL/kAh, respectively, for the plating. An amine-based chelating agent IZ-250YB was supplied at an IZ-250YB supply rate of 80 mL/kAh for the plating. Every 200 Ah/L current application, the concentration of the amine-based chelating agent and the concentration of the nitrogen-containing heterocyclic quaternary ammonium salt-based brightening agent were analyzed. In addition, a plating test was conducted in accordance with the Hull cell test by using a long cell using a 20 cm iron plate as a cathode, and the appearance of plating, the film thickness distribution, and the Ni co-deposition ratio distribution were measured. Note that the conditions for the plating test were 4 A, 20 minutes, and 25° C.

Composition of Plating Liquid:

Zn ion concentration: 8 g/L (Zn ion source was $Na_2[Zn(OH)_4]$)

Ni ion concentration: 1.6 g/L (Ni ion source was $NiSO_4.6H_2O$)

Caustic soda concentration: 130 g/L

Amine-based chelating agent IZ-250YB (manufactured by DIPSOL CHEMICALS Co., Ltd.): 60 g/L Brightening agent IZ-250YR1 (manufactured by DIPSOL CHEMICALS Co., Ltd.): 0.6 mL/L Brightening agent IZ-250YR2 (manufactured by DIPSOL CHEMICALS Co., Ltd.): 0.5 mL/L

TABLE 1

Course of Concentrations of Amine-Based Chelating Agent and Nitrogen-Containing Heterocyclic Quaternary Ammonium Salt-Based Brightening Agent

| Amount of | Example 1 | | Example 2 | | Comp. Ex. 1 | |
|---|---|---|---|---|---|---|
| current applied (Ah/L) | IZ-250 YB (g/L) | IZ-250 YR2 (mL/L) | IZ-250 YB (g/L) | IZ-250 YR2 (mL/L) | IZ-250 YB (g/L) | IZ-250 YR2 (mL/L) |
| 0 | 60 | 0.6 | 60 | 0.6 | 60 | 0.6 |
| 200 | 59 | 0.6 | 61 | 0.6 | 51 | 0.4 |
| 400 | 56 | 0.6 | 57 | 0.6 | 32 | 0.1 |
| 400 (concentration of IZ-250YB was adjusted to 60 g/L) | — | — | — | — | 60 | 0.1 |

The following effects were observed in Examples 1 and 2 in comparison with Comparative Example 1.

(1) Decomposition of the amine-based chelating agent was suppressed.

(2) Deterioration of appearance of the plating was suppressed.

(3) Decomposition of the nitrogen-containing heterocyclic quaternary ammonium salt-based brightening agent was suppressed.

(4) Decrease in Ni co-deposition ratio in a low-current portion was suppressed.

The present invention has enabled the lifetime extension of an alkaline zinc alloy plating liquid, especially an alkaline zinc-nickel alloy plating liquid, containing a nitrogen-containing heterocyclic quaternary ammonium salt-based brightening agent. In addition, the lifetime extension of an alkaline zinc alloy plating liquid, especially an alkaline zinc-nickel alloy plating liquid has enabled stabilization of plating qualities, reduction in plating time, and reduction of the load on wastewater treatment.

The invention claimed is:

1. A zinc alloy electroplating method comprising applying a current through an alkaline zinc alloy electroplating bath comprising a cathode and an anode, wherein a cathode region including the cathode and an anode region including the anode are separated from each other by a separator comprising a three-layered composite membrane in which an anion exchange membrane, a membrane of an electrically conductive electrolyte gel, and another anion exchange membrane are stacked in this order, a catholyte contained in the cathode region is an alkaline zinc alloy plating liquid, which is an alkaline zinc-nickel alloy plating liquid, and the electrically conductive electrolyte gel is an electrolyte gel of a water-absorbing synthetic polymer swollen by absorption of an aqueous sodium hydroxide solution as an electrolyte.

2. The zinc alloy electroplating method according to claim 1, wherein the synthetic polymer electrolyte gel is an electrolyte gel of a water-absorbing synthetic polymer with an electrical conductivity of 140000 μS/cm or higher.

3. The zinc alloy electroplating method according to claim 1, wherein the water-absorbing synthetic polymer comprises one or more selected from the group consisting of polyvinyl alcohol, polyethylene glycol, poly(carboxylic acids), and modified products thereof.

4. The zinc alloy electroplating method according to claim 1, wherein an anolyte contained in the anode region is an aqueous alkaline solution, and the aqueous alkaline solution is an aqueous solution comprising one or more selected from the group consisting of sodium hydroxide, sodium, potassium, and ammonium salts of inorganic acids, and quaternary tetraalkylammonium hydroxides.

5. The zinc alloy electroplating method according to claim 4, wherein the aqueous alkaline solution is an aqueous sodium hydroxide solution, and the concentration of the aqueous sodium hydroxide solution is in a range from 0.5 to 8 mol/L.

6. The zinc alloy electroplating method according to claim 4, further comprising controlling an alkali concentration of the aqueous alkaline solution by adding an alkali component to the aqueous alkaline solution.

7. The zinc alloy electroplating method according to claim 1, wherein the anode is selected from the group consisting of iron, stainless steel, nickel, and carbon.

8. The zinc alloy electroplating method according to claim 1, wherein the alkaline zinc-nickel alloy plating liquid comprises zinc ions, nickel ions, a caustic alkali, an amine-based chelating agent, and a nitrogen-containing heterocyclic quaternary ammonium salt-based brightening agent.

9. The zinc alloy electroplating method according to claim 8, wherein the nitrogen-containing heterocyclic quaternary ammonium salt-based brightening agent comprises a quaternary ammonium salt of nicotinic acid or a derivative thereof.

* * * * *